United States Patent [19]

Rocker et al.

[11] 3,999,490

[45] Dec. 28, 1976

[54] SECURITY TOP OR GUARD FOR AN INFANT'S DRESSING TABLE OR THE LIKE

[75] Inventors: Elmer Rocker, Lyndhurst, Ohio; James W. Gaydos, deceased late of Shaker Heights, Ohio, by Mary F. Gaydos, executrix

[73] Assignee: Century Products, Inc., Cleveland, Ohio

[22] Filed: Oct. 6, 1975

[21] Appl. No.: 619,612

[52] U.S. Cl. ..... 108/27; 5/99 B; 108/63; 108/112

[51] Int. Cl.[2] ..... A47B 17/00

[58] Field of Search ..... 108/27, 63, 64, 83, 108/89, 112, 114; 16/171, 172; 312/201; 211/132, 149; 160/135, 351; 220/337; 5/99 B

[56] References Cited

UNITED STATES PATENTS

| | | | |
|---|---|---|---|
| 891,235 | 6/1908 | Diehl | 16/172 |
| 922,720 | 5/1909 | Peters et al. | 16/172 |
| 1,378,878 | 5/1921 | Larson | 108/83 |
| 2,597,330 | 5/1952 | Huddleston | 108/112 X |
| 3,313,584 | 4/1967 | Rocker | 108/63 X |
| 3,777,673 | 12/1973 | Blazey et al. | 108/27 |

*Primary Examiner*—Ramon S. Britts
*Assistant Examiner*—Darrell Marquette
*Attorney, Agent, or Firm*—Isler and Ornstein

[57] ABSTRACT

A top or guard for an infant's dressing table or dresserette is provided which is so designed and constructed as to reduce or minimize the possibility of the infant rolling or falling off the table. The top is of such construction that it can be shortened to conform in dimensions or area with the table or dresserette when the latter is folded or closed. It comprises sections, one of which is pivotally movable in relation to the other whereby the movable section may be folded to a position in superimposed and enclosing relation to the other. A feature comprises the securement of the movable section to the other section, in hinged relationship, without the provision of hinges which are permanently secured to the sections. Another feature is the provision of means on one of the sections for causing the other section to be moved into coplanar relationship with the other, when the sections are in open position.

5 Claims, 12 Drawing Figures

SECURITY TOP OR GUARD FOR AN INFANT'S DRESSING TABLE OR THE LIKE

This invention relates generally to dressing tables or dresserettes for infants, but has reference more particularly to improvements in the type of table disclosed in the Rocker U.S. Pat. No. 3,313,584 and the Blazey et al. U.S. Pat. No. 3,777,673.

The invention will be described more particularly with reference to a dressing table or dresserette of the foldable type, although it may be used with other types of infant's dressing tables.

In the aforesaid patents, an infant's dressing table is disclosed, provided with a top which is adapted to support the infant during dressing and undressing of the infant, and with drawers below the table top, some of which drawers are movable into superimposed or tier-like relationship with the other drawers, when the table is folded or closed.

In the Blazey et al patent, the table top comprises two sections, one of which is telescopically movable relatively to the other for the purpose of shortening or lengthening the top. The table top is of relatively complicated construction, embodying a safety belt, which must be moved to a non-obstructing position to enable one of the top sections to be moved into superimposed relationship with the other. Another disadvantage is that when the movable section of the top is moved into superimposed relation to the other, the top is left exposed to the falling of dust and other foreign matter onto the infant supporting surface of the top.

The present invention has, as its primary object, the provision of a table top of the character described, in which the aforesaid and other disadvantages are overcome by hingedly securing the movable section of the table top to the other section, whereby the movable section is pivotally movable over the other section to thereby constitute a cover for said other section, as well as to provide an enclosed storage space, which is not exposed to access of dust and other foreign matter.

Another object of the invention is to provide a table top of the character described, in which the pivotal connection of the sections to each other is accomplished without permanent connection of the sections to each other.

Another object of the invention is to provide a table top of the character described, in which a safety belt is employed which does not require removal from the top when the movable section is moved to closed position.

A further object of the invention is to provide a table top of the character described, in which one of the sections is provided with means for camming the other section into coplanar relationship therewith.

Other objects and advantages of my invention will be apparent during the course of the following description.

In the accompanying drawings forming a part of this specification, and in which like numerals are employed to designate like parts throughout the same, FIG. 1 is a perspective view of an infant's dressing table, in open or unfolded condition, and showing the table top in unfolded or operative position, but without the removable protective or cushioning pad thereon;

Figure 2:
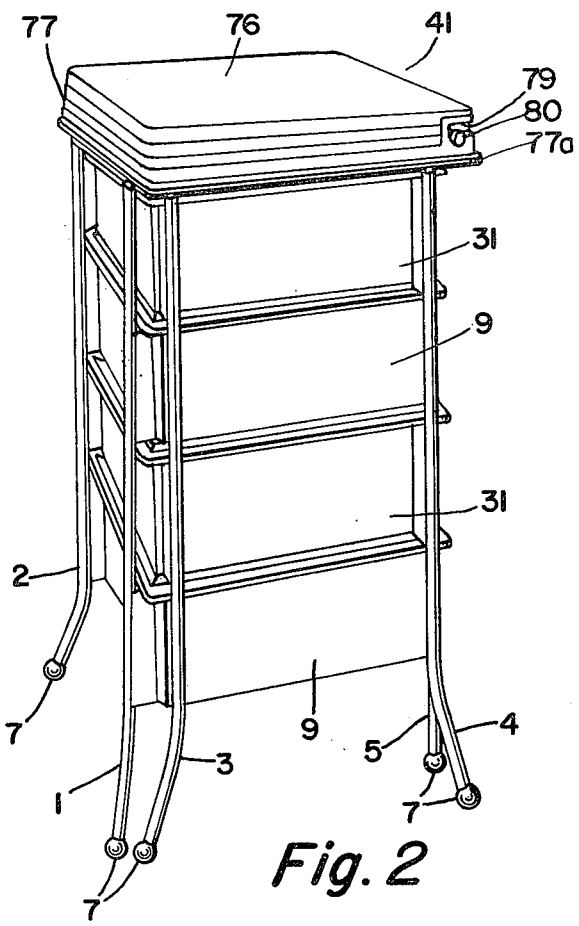
FIG. 2 is a perspective view of the table in closed or folded condition, and showing the table top in folded or closed position, after the cushioning pad has been removed.

Referring more particularly to the drawings, the table, without the top, is of a construction similar to that of Rocker U.S. Pat. No. 3,313,584 and Blazey et al. U.S. Pat. No. 3,777,673, and may be briefly described as follows:

The top of the dressing table comprises two sections, one a stationary or base section, designated generally by reference numeral 40, and the other a movable or cover section foldable over the section 40, and designated generally by reference numeral 41.

Each of the sections is molded, in one piece, of a plastic, such, for example, as high impact styrene.

The dressing table comprises a pair of long tubular end legs 1 and 2, a second pair of tubular end legs 3 and 4, a short intermediate leg 5, and a long intermediate leg 6. The end legs 1, 2, 3 and 4, and the intermediate leg 6, are flared outwardly at their lower ends for purposes of stability and attractiveness of appearance, and these flared portions as well as the lower end of the leg 5 terminate in ball-shaped elements 7 which facilitate movement of the dressing table along a floor. For this purpose, coasters, glides, casters and the like may be used.

Secured to the legs 1 and 2, in the manner described in the aforesaid Rocker patent, is a pair of vertically-spaced drawers or bins 9, each of which is preferably molded, in a single piece, from a plastic, such as polyethylene or polypropylene.

The intermediate leg 5 of the dressing table extends upwardly to a level just below the upper edge of the lower drawer or bin 9, and is secured to the side of this drawer by means of sheet metal screws (not shown).

The intermediate leg 6 of the dressing table extends through tubular corners 22 of the drawers 9, and is locked against vertical movement relatively to these drawers by means of a sheet metal screw which extends through the tubular corner 22 of the lower drawer 9 and into the leg 6, as described in the aforesaid Rocker patent.

The dressing table further includes a pair of vertically-spaced drawers or bins, in staggered and overlapping relationship to the drawers 9, and which are designated generally by reference numeral 31. Each of these drawers 31 is preferably of a construction and material identical with the drawers 9.

The drawers 31 are secured to the legs 3 and 4 of the dressing table in the same manner that the drawers 9 are secured to the legs 1 and 2.

Figure 1:
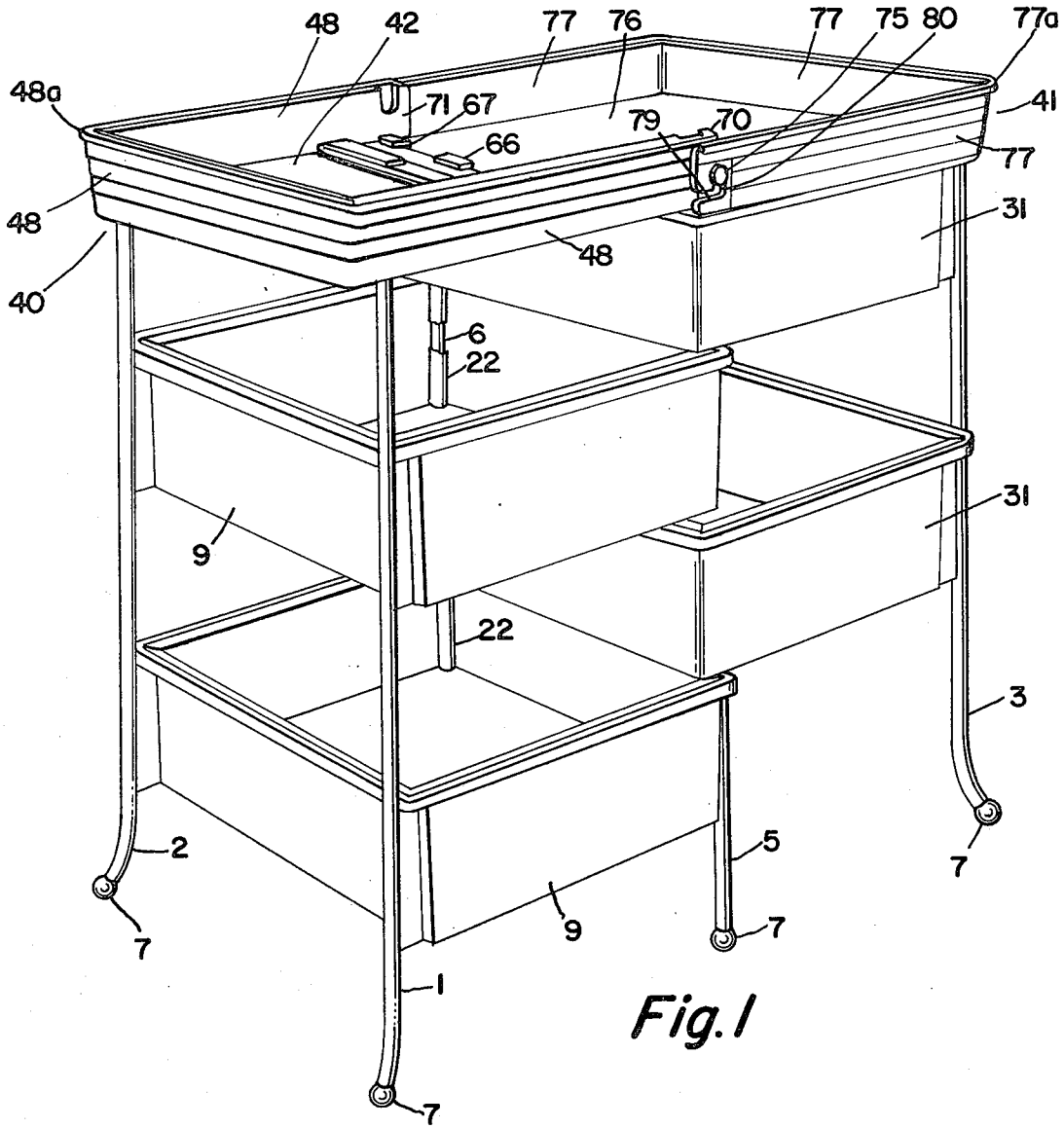

Each of the drawers 31 is molded at its rear left corner, as viewed in FIG. 1, to provide a tubular corner (not shown), similar to the corner 22, through which the leg 6 extends.

With the drawers 31 and 9 assembled in the manner shown in FIG. 1, the drawers 31 rest on the drawers 9 and the portion of the table comprising the drawers 31 and legs 3 and 4 may be swung horizontally about the leg 6 to the closed position shown in FIG. 2.

The base or stationary section 40 of the table top is molded to provide a flat base 42, and a flange 48 which extends upwardly from both sides and one end of the base, and is inclined outwardly, terminating at its upper end in an out-turned horizontal portion 48*a*.

The base 42 is provided with depending bosses 57 (FIGS. 3, 4, 5, 6, 7 and 12), which are secured, as by screws 58, to the horizontal legs 59 of angles 60, the vertical legs 61 of which are secured, as by screws 62, to the upper ends of the legs 1 and 2.

Figure 9:
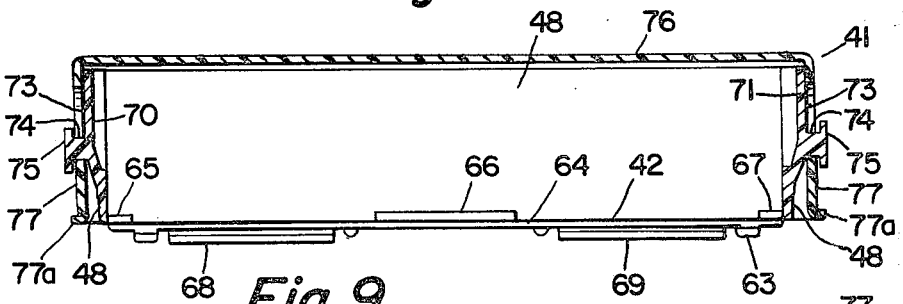
FIG. 9 is a cross-sectional view, taken on the line 9—9 of FIG. 5.
Figure 10:
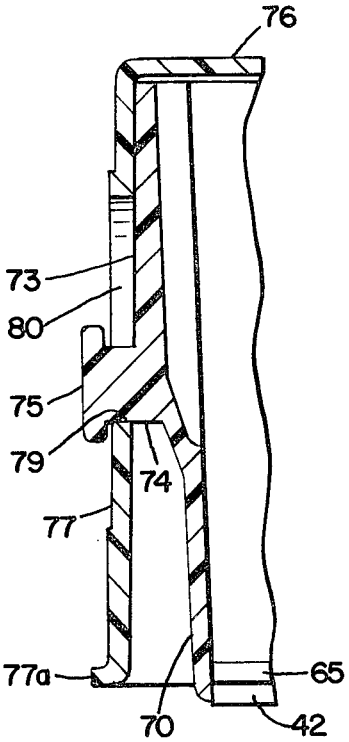
FIG. 10 is a view corresponding to the left end of FIG. 9, but on a greatly enlarged or full-size scale.
Figure 11:
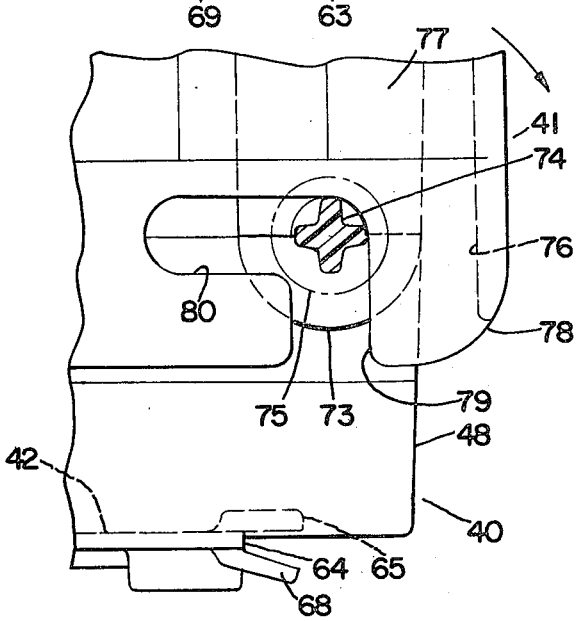
FIG. 11 is a fragmentary side elevational view, showing the manner in which the movable or cover section of the table top is pivotally secured to the stationary or base section.
Figure 12:
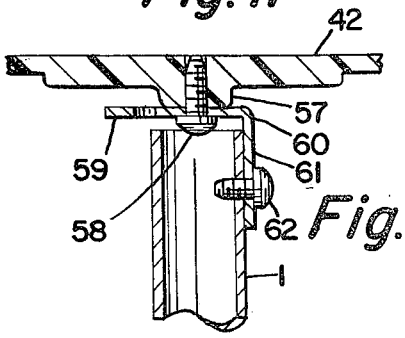
FIG. 12 is a fragmentary cross-sectional view, taken on the line 12—12 of FIG. 4.

The base 42 is further provided with a depending boss 63 (FIGS. 3 and 9), which is secured to the upper end of the leg 6 of the table in a manner similar to that shown in FIG. 11 of the aforesaid Rocker patent.

Figure 3:
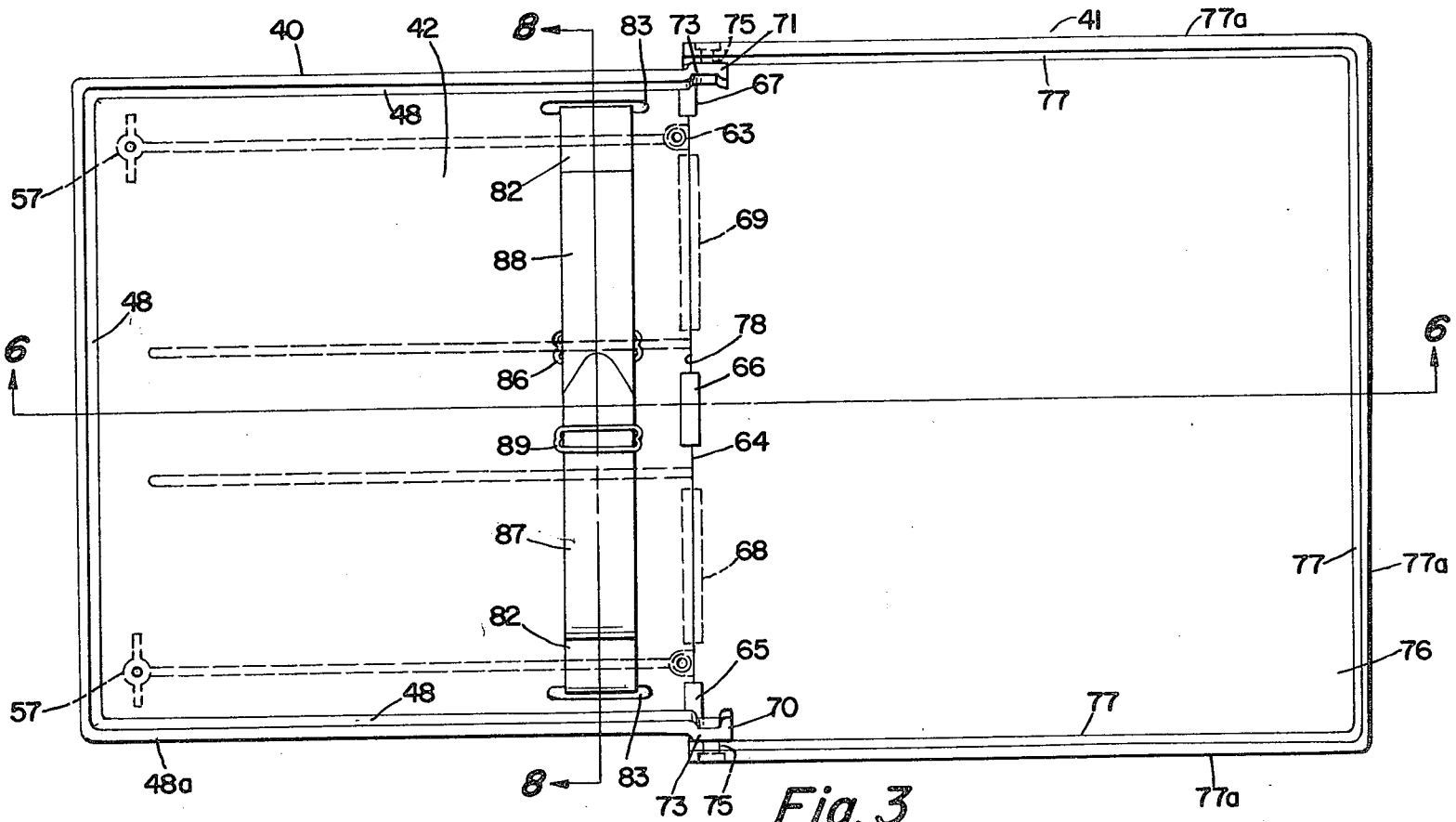
FIG. 3 is a top plan view of the table top in its unfolded or operative position.
Figure 6:
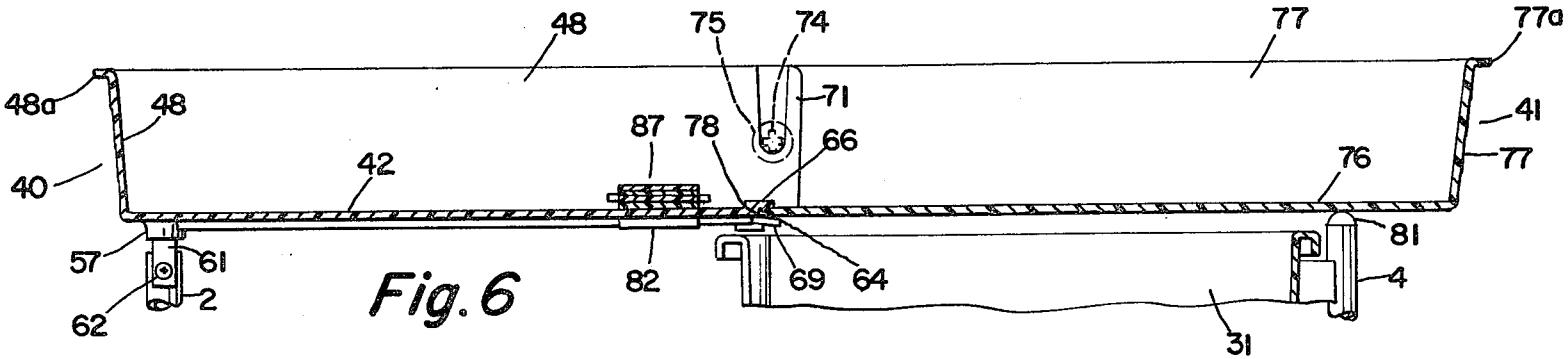
FIG. 6 is a fragmentary cross-sectional view, taken on the line 6—6 of FIG. 3.
Figure 7:
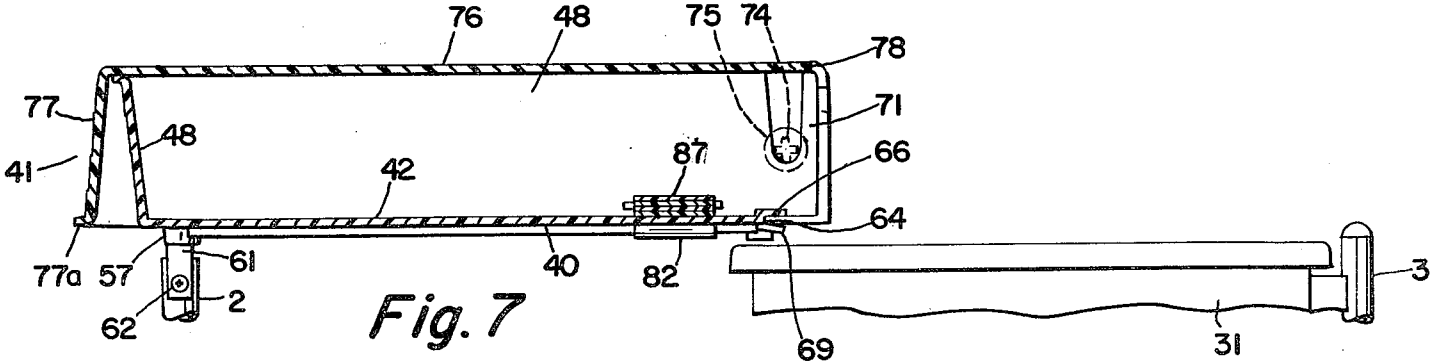
FIG. 7 is a view similar to FIG. 6, but with the movable or cover section of the table top, in folded or closed position.
Figure 8:
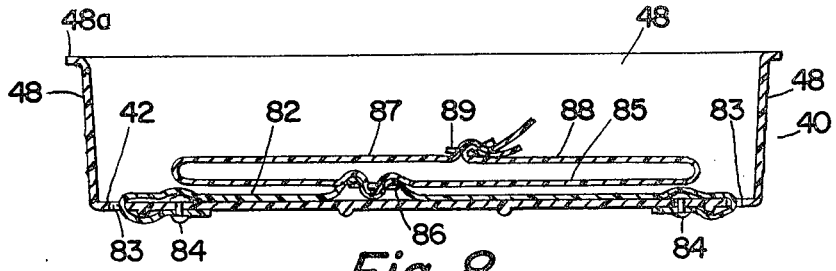
FIG. 8 is a cross-sectional view, taken on the line 9—9 of FIG. 5.

The base 42 of the stationary or base section 40 of the table top terminates at the end thereof opposite the flange 48, in an unflanged edge 64 (FIGS. 3, 6 and 7). The base 42 has molded integrally therewith, spaced pads 65, 66 and 67 (FIGS. 3 and 9) which overhang the edge 64, and are parallel with the base 42. The base 42 also has molded integrally therewith, spaced pads 68 and 69 (FIGS. 3 and 9) which underlie the base 42 and extend beyond the edge 64 and at a slight angle to the plane of the pads 65, 66 and 67, as best seen in FIG. 11. The function of the pads 65, 66, 67, 68 and 69 will be presently explained.

The flange 48 at the sides of the base 42 is extended beyond the edge 64, to provide extensions 70 and 71, each of which is molded to provide an offset 73 (FIGS. 3, 9, 10 and 11) from which a hinge post 74 of cruciform cross-section extends, having a terminal circular end 75 of enlarged diameter. The hinge posts 74 serve a function to be presently described.

The movable or cover section 41 of the table top is molded to provide a flat base 76 and a flange 77 which, as viewed in FIGS. 3 and 6, extends upwardly from both sides and one end of the base, and is inclined outwardly, terminating at its upper end in an out-turned horizontal portion 77*a*.

The base 76 of the movable or cover section of the table top terminates at the end thereof opposite the flange 77 in an unflanged edge 78 (FIGS. 3, 6 and 7).

The portions of the flanges 77 adjacent the edge 78 of the base are provided with slots similar to a bayonet joint slot, comprising an entrant portion 79 and a locking portion 80 (see FIGS. 1, 2, 4, 5 and 11), which are designed to receive the hinge port 74, for the purpose of permitting the movable or cover section of the table top to be moved to folded and unfolded position.

In assembling the section 41 with the section 40, the section 41 is moved downwardly in relation to the section 40 in the manner shown in FIG. 11, to cause the hinge post 74 to move to the position shown in FIG. 11. The section 41 is then moved from the position shown in FIG. 11 to the right, to thereby cause the hinge post 74 to move to the left end of the slot portion 80. With the hinge post 74 in such position, the section 41 may then be swung about the hinge post, in the direction indicated by the arrow in FIG. 11 to the unfolded or open position shown in FIGS. 3 and 4.

In the course of such movement, the edge 78 of the base 76 comes into contact with the upper surfaces of the pads 68 and 69 of the stationary or base section 40, causing these surfaces to cam the edge 78 upwardly and into contact with the edge 64 of the stationary or base section. Movement of the base 76 above the plane of the base 42 is prevented by the pads 65, 66 and 67.

Figure 4:
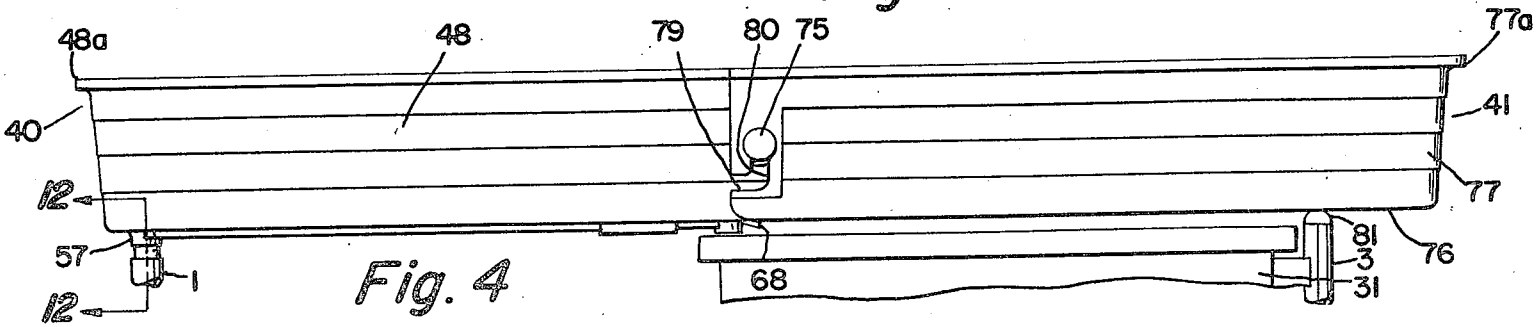
FIG. 4 is a fragmentary side elevational view of the table top in its unfolded or operative position, as viewed from the bottom of FIG. 3.
Figure 5:
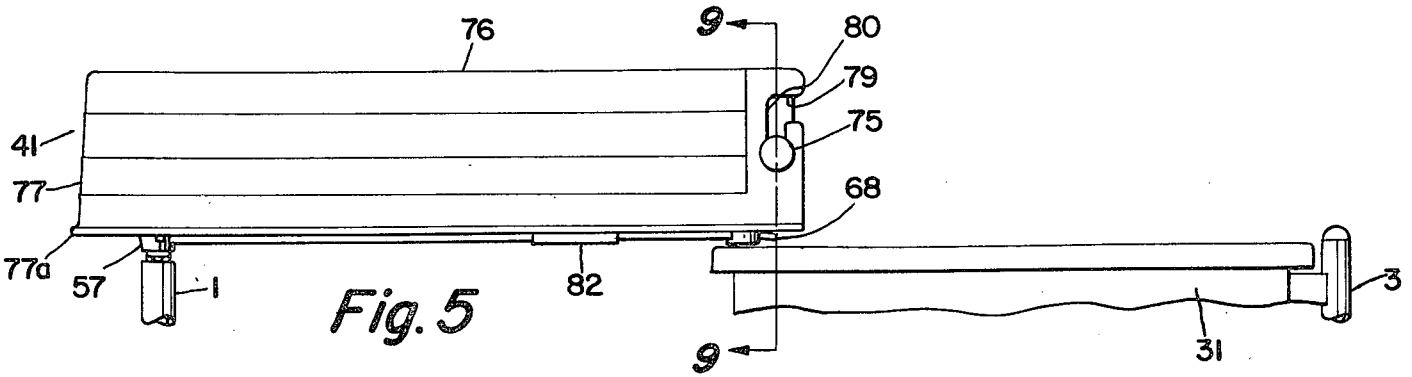
FIG. 5 is a view similar to FIG. 4, but with the movable or cover section of the table top, in folded or closed position.

In the unfolded or open position of the section 41, the section 41 rests on the rounded upper ends 81 of the legs 3 and 4, as shown in FIGS. 4 and 6.

With the table top in the position shown in FIGS. 1, 3, 4 and 6, an infant may be laid on the table top, for the purpose of dressing or undressing it, or otherwise attending to the needs of the infant, and the flanges 48 and 77 are of sufficient height to prevent the infant from rolling or falling off the table top, should the infant be left unattended.

When it is desired to move the section 41 to the closed position shown in FIGS. 2, 5, 7, 9 and 10, it is only necessary to swing the section 41 about the hinge posts 74 and into such position, in which position, the section 41 covers and substantially completely encloses the section 40.

The table top is also provided with a safety belt for the purpose of securing the infant to the top, or rather, to an underlyiing cushion or pad (not shown), which is placed on the bases 42 and 76 of the top.

The safety belt, which is best shown in FIGS. 1, 3, 4, 5, 6, 7 and 8, and is preferably made of a plastic, such, for example, as vinyl, comprises a section 82, the ends of which are passed through slots 83 in the base 42, and secured to the bottom of the base by means of screws 84.

The safety belt further includes a section 85, which is secured to the section 82, as by a clasp 86, and is provided with end portions 87 and 88, which are adjustably secured to each other by means of a buckle 89.

When the table top is in the open position shown in FIGS. 1, 3, 4 and 6, and it is desired to secure the infant to the top, the portion 87 of the section 82 of the belt is pulled through the buckle 89, and the portions 87 and 88 swung over the flanges 84.

The infant is then laid on the section 82, or rather, on a cushion or pad (not shown) which is placed on the bases 42 and 76 of the top.

With the table top in the closed position shown in FIGS. 2, 5, 7, 9 and 10, the legs 3 and 4 of the dressing table, together with the drawers 31 which are supported thereby, can be swung horizontally about the leg 6 from the position shown in FIG. 1 to that shown in FIG. 2.

It is thus seen that we have provided a top for an infant's dressing table, which is of such construction as to reduce or minimize the possibility of an infant rolling or falling off the table.

It is also seen that we have provided a top of the character described, which is especially adapted for use with a table or dresserette which is foldable, since the top can be shortened or folded to a dimension which conforms substantially to the dimensions of the folded table or dresserette.

It is further seen that we have provided a top of the character described, in which the movable section of the top is pivotally movable to a position such that it constitutes a cover for the other section, forms with the other section an enclosure for storage purposes, and prevents entry of dust and other foreign matter into said enclosure.

It is still further seen that we have provided a table top of the character described, in which the pivotal connection of the sections is accomplished without permanent connection of the sections to each other; in which one of the sections is provided with means for camming the other section into coplanar relationship therewith, and in which a safety belt is employed which does not require removal from the top when the movable section is moved to closed position.

It is to be understood that the form of our invention, herewith shown and described, is to be taken as a preferred example of the same, and that various changes may be made in the shape, size and arrangement of parts thereof, without departing from the spirit of the invention or the scope of the subjoined claims.

Having thus described our invention, we claim:

1. In combination with an infant's dressing table or the like, said table comprising a stationary section, and a movable section which is pivotally movable and nestable into the stationary section, a top for said table, said top comprising a first section secured to and overlying the stationary section of the table and comprising a substantially rectangular flat base and upstanding flanges at one end and opposite sides of said base, and a second section overlying the movable section of the table and comprising a substantially rectangular flat base of greater dimensional area than the base of the first section and upstanding flanges at one end and opposite sides of said base of said second section, all of said flanges being of substantial height and adapted to prevent an infant on said top from rolling or falling off the top, said second section being pivotally movable into overlying relationship to said first section when the movable section of the table has been nested into the stationary section of the table, whereby the base of said second section is in parallel spaced relationship with the base of the first section and defines with the latter a hollow space of substantial depth, the flanges of the second section are in inverted relationship to the flanges of the first section, and the first section engaging the interior surface of the base of the second section.

2. The combination, as defined in claim 1, wherein the flanges of the second section of the table top encompass or surround the flanges of the first section of the table top when the second section of the table top has been moved into said overlying relationship.

3. The combination, as defined in claim 2, wherein the first section of the table top is provided with hinge posts, to which the second section of the table top is adapted to be hingedly secured, said securement being effected without the aid of tools.

4. The combination, as defined in claim 3, wherein said first section of the table top is provided with means for camming the base of the second section of the table top into coplanar relationship with the base of the first section of the table top when said second section of the table top is moved out of said overlying relationship.

5. The combination, as defined in claim 4, wherein said last-named means comprises spaced flanges extending downwardly and at an angle to the base of said first section of the table top.

* * * * *